US005671679A

United States Patent [19]

Straub et al.

[11] Patent Number: 5,671,679

[45] Date of Patent: Sep. 30, 1997

[54] FULLY AUTOMATIC, MULTIPLE OPERATION RAIL MAINTENANCE APPARATUS

[75] Inventors: William D. Straub, Milwaukee; Bruce M. Boczkiewicz, Mukwonago; David S. Johnsen, Milwaukee, all of Wis.

[73] Assignee: Nordco Inc., Milwaukee, Wis.

[21] Appl. No.: 642,244

[22] Filed: Apr. 24, 1996

[51] Int. Cl.[6] ..... E01B 29/24

[52] U.S. Cl. ..... 104/2; 104/17.1; 81/470

[58] Field of Search ..... 104/2, 16, 17.1, 104/17.2; 81/52.41, 470

[56] References Cited

U.S. PATENT DOCUMENTS

| | | | |
|---|---|---|---|
| 3,628,461 | 12/1971 | Plasser et al. . | |
| 3,690,264 | 9/1972 | Plasser et al. . | |
| 3,745,930 | 7/1973 | Dieringer | 104/17.1 |
| 3,759,334 | 9/1973 | Theurer | 104/17.1 |
| 3,942,000 | 3/1976 | Deiringer | 104/17.1 |
| 4,131,066 | 12/1978 | Lund | 104/17.1 |
| 4,165,694 | 8/1979 | Theurer | 104/12 |
| 5,191,840 | 3/1993 | Cotic et al. | 104/17.1 |
| 5,398,616 | 3/1995 | Eidemanis et al. | 104/17.2 |
| 5,465,667 | 11/1995 | Hosking et al. | 104/17.2 |
| 5,487,341 | 1/1996 | Newman et al. | 104/17.1 |

*Primary Examiner*—S. Joseph Morano

*Attorney, Agent, or Firm*—Greer, Burns & Crain, Ltd.

[57] ABSTRACT

A system for detecting targets and for positioning at least one work module over a particular target to perform a task thereon. The system includes a movable machine having a main frame, a drive mechanism for propelling the machine across a base surface, a sensor associated with the machine for detecting locations of at least one target positioned on said base surface, and an encoder assembly associated with the machine for obtaining motion data. The motion data includes at least one of the displacement and velocity of the machine across the base surface. Also included is a control unit for receiving the target locations from the sensor, for receiving the motion data from the encoder assembly, for determining a target distance for the drive mechanism to propel the machine such that the work module is generally aligned with a particular target in a target area, and for creating a destination signal indicating when the work module is operationally aligned with the target area.

36 Claims, 8 Drawing Sheets

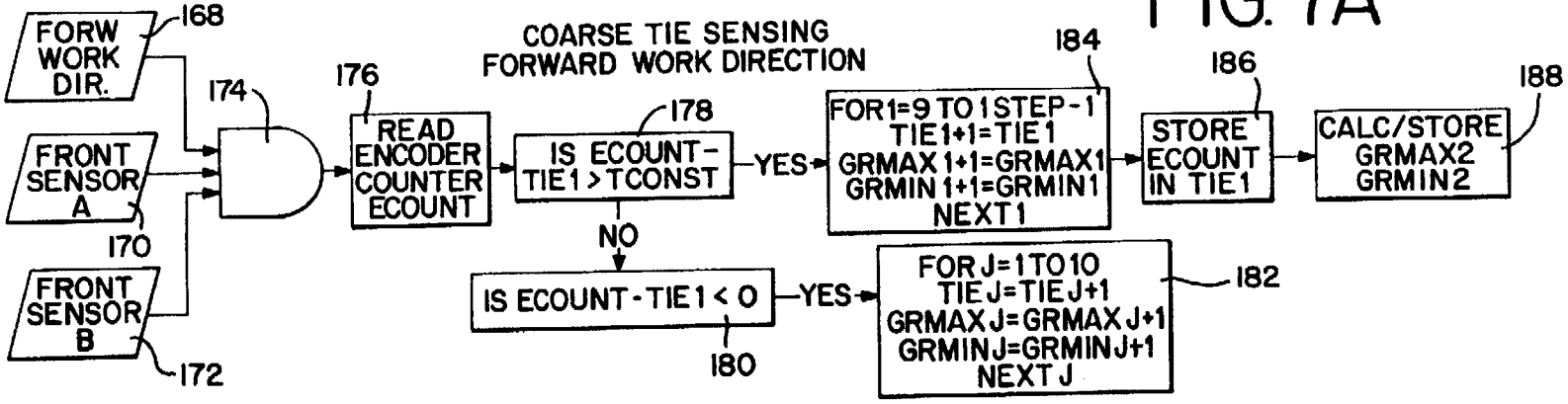
FIG. 7A
COARSE TIE SENSING
FORWARD WORK DIRECTION
FORW WORK DIR.
FRONT SENSOR A
FRONT SENSOR B
READ ENCODER COUNTER ECOUNT
IS ECOUNT-TIE1 > TCONST
YES
NO
FOR I=9 TO 1 STEP-1
TIE I+1=TIE I
GRMAX I+1=GRMAX I
GRMIN I+1=GRMIN I
NEXT I
STORE ECOUNT IN TIE1
CALC/STORE GRMAX2 GRMIN2
IS ECOUNT-TIE1 < 0
YES
FOR J=1TO10
TIE J=TIE J+1
GRMAX J=GRMAX J+1
GRMIN J=GRMIN J+1
NEXT J
168
170
172
174
176
178
180
182
184
186
188

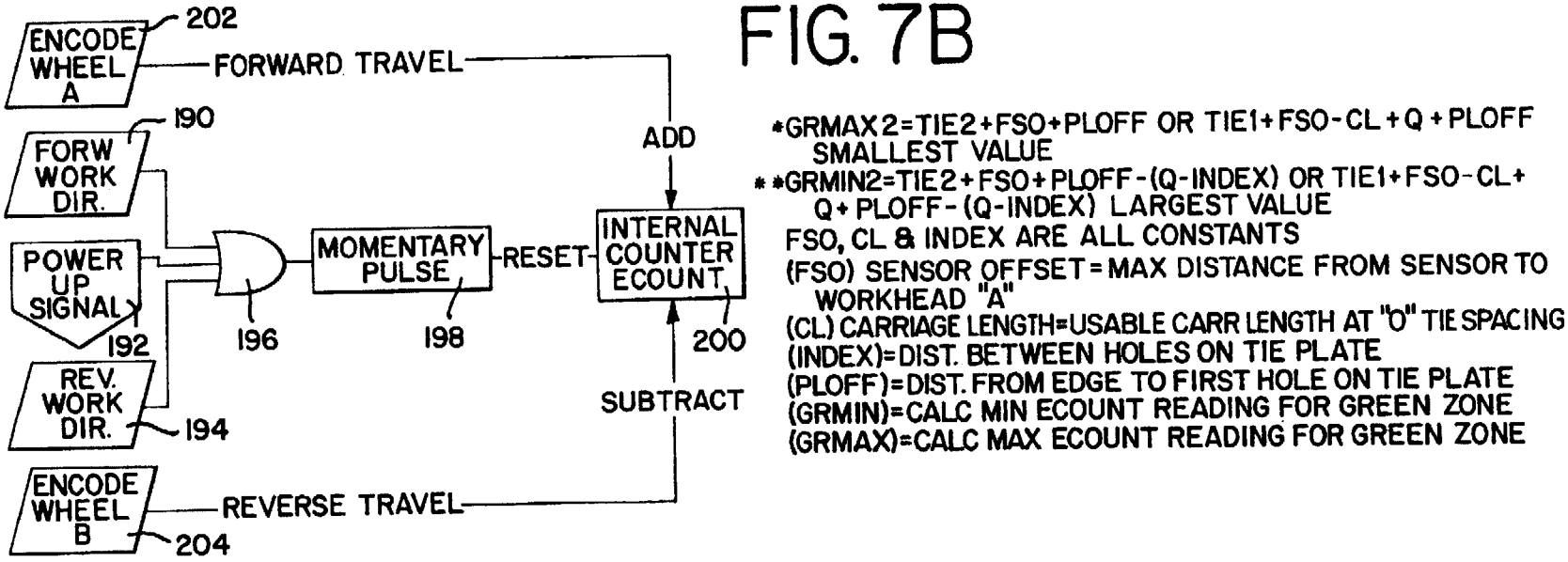
FIG. 7B
*GRMAX2=TIE2+FSO+PLOFF OR TIE1+FSO-CL+Q+PLOFF
SMALLEST VALUE
**GRMIN2=TIE2+FSO+PLOFF-(Q-INDEX) OR TIE1+FSO-CL+
Q+PLOFF-(Q-INDEX) LARGEST VALUE
FSO, CL & INDEX ARE ALL CONSTANTS
(FSO) SENSOR OFFSET=MAX DISTANCE FROM SENSOR TO
WORKHEAD "A"
(CL) CARRIAGE LENGTH=USABLE CARR LENGTH AT "0" TIE SPACING
(INDEX)=DIST. BETWEEN HOLES ON TIE PLATE
(PLOFF)=DIST. FROM EDGE TO FIRST HOLE ON TIE PLATE
(GRMIN)=CALC MIN ECOUNT READING FOR GREEN ZONE
(GRMAX)=CALC MAX ECOUNT READING FOR GREEN ZONE
ENCODE WHEEL A
FORWARD TRAVEL
FORW WORK DIR.
POWER UP SIGNAL
REV. WORK DIR.
ENCODE WHEEL B
REVERSE TRAVEL
MOMENTARY PULSE
RESET
INTERNAL COUNTER ECOUNT
ADD
SUBTRACT
190
192
194
196
198
200
202
204

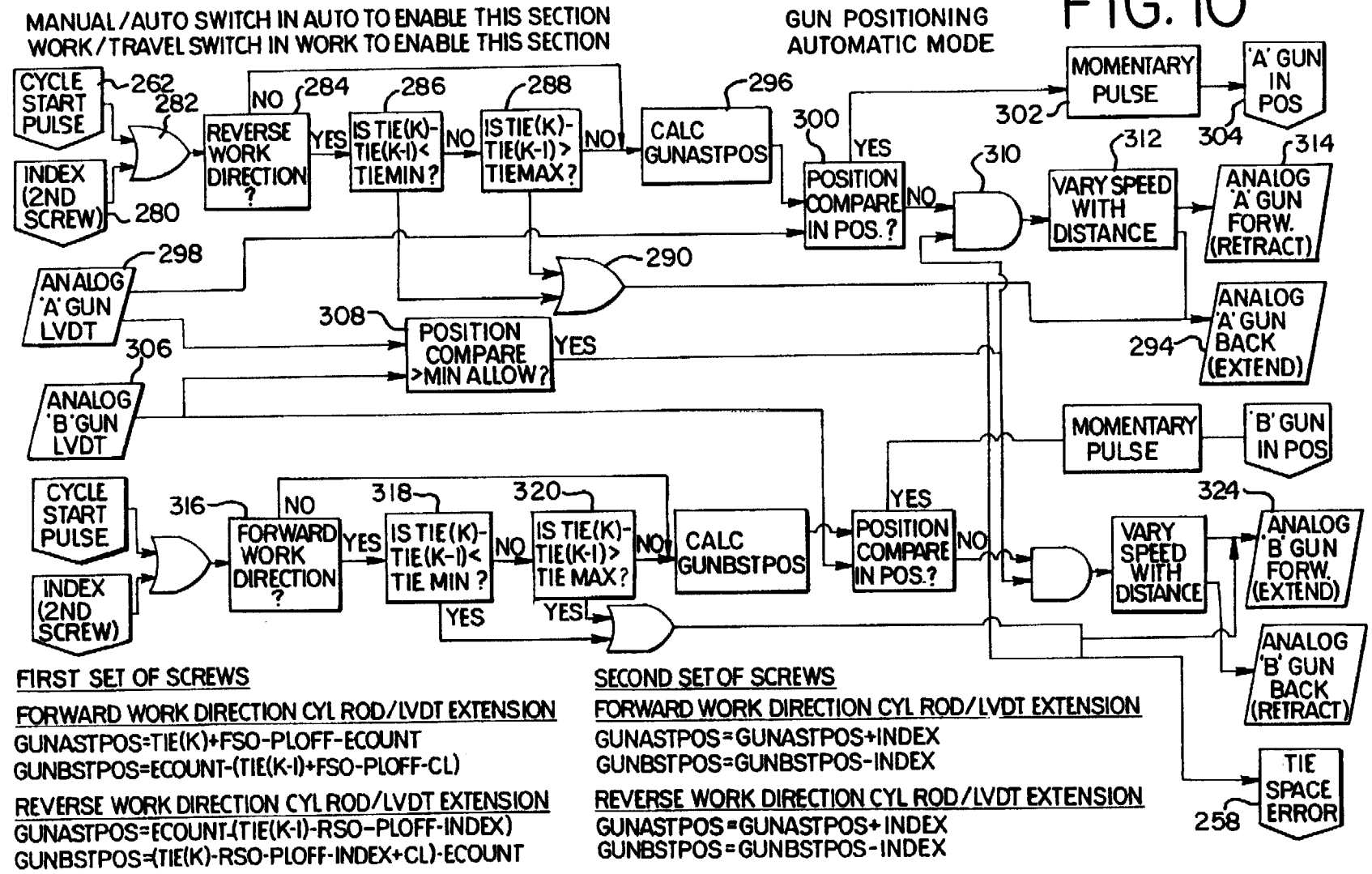
FIG. 10
GUN POSITIONING
AUTOMATIC MODE
MANUAL/AUTO SWITCH IN AUTO TO ENABLE THIS SECTION
WORK/TRAVEL SWITCH IN WORK TO ENABLE THIS SECTION
CYCLE START PULSE
INDEX (2ND SCREW)
ANALOG 'A' GUN LVDT
ANALOG 'B' GUN LVDT
REVERSE WORK DIRECTION ?
IS TIE(K)-TIE(K-1)< TIEMIN?
IS TIE(K)-TIE(K-1)> TIEMAX?
CALC GUNASTPOS
POSITION COMPARE IN POS.?
MOMENTARY PULSE
VARY SPEED WITH DISTANCE
'A' GUN IN POS
ANALOG 'A' GUN FORW. (RETRACT)
ANALOG 'A' GUN BACK (EXTEND)
POSITION COMPARE >MIN ALLOW?
FORWARD WORK DIRECTION ?
IS TIE(K)-TIE(K-1)< TIE MIN ?
IS TIE(K)-TIE(K-1)> TIE MAX?
CALC GUNBSTPOS
'B' GUN IN POS
ANALOG 'B' GUN FORW. (EXTEND)
ANALOG 'B' GUN BACK (RETRACT)
TIE SPACE ERROR
YES
NO
FIRST SET OF SCREWS
FORWARD WORK DIRECTION CYL ROD/LVDT EXTENSION
GUNASTPOS=TIE(K)+FSO-PLOFF-ECOUNT
GUNBSTPOS=ECOUNT-(TIE(K-1)+FSO-PLOFF-CL)
REVERSE WORK DIRECTION CYL ROD/LVDT EXTENSION
GUNASTPOS=ECOUNT-(TIE(K-1)-RSO-PLOFF-INDEX)
GUNBSTPOS=(TIE(K)-RSO-PLOFF-INDEX+CL)-ECOUNT
SECOND SET OF SCREWS
FORWARD WORK DIRECTION CYL ROD/LVDT EXTENSION
GUNASTPOS=GUNASTPOS+INDEX
GUNBSTPOS=GUNBSTPOS-INDEX
REVERSE WORK DIRECTION CYL ROD/LVDT EXTENSION
GUNASTPOS=GUNASTPOS+INDEX
GUNBSTPOS=GUNBSTPOS-INDEX
262
280
282
284
286
288
290
294
296
298
300
302
304
306
308
310
312
314
316
318
320
324
258

FULLY AUTOMATIC, MULTIPLE OPERATION RAIL MAINTENANCE APPARATUS

BACKGROUND OF THE INVENTION

The present invention is generally related to a method and apparatus for detecting the locations of a number of target areas where predetermined tasks are to be performed, and for positioning a module for performing the predetermined tasks over those areas in either a fully automatic or semi-automatic manner. In the preferred embodiment, the present invention is related to a method and apparatus for detecting the locations of tie plates of a railroad track, for positioning a railroad maintenance module and its operational module over a particular tie plate, and for performing a predetermined task upon the particular tie plate. Some of the types of tasks which may be performed by the method and apparatus of the preferred embodiment include the various railway maintenance steps. Examples of these tasks include, but are of course not limited to, drilling holes for lag screws, driving and/or removing lag screws, spiking and/or removing spikes, or clips, and tightening nuts securing tie plates to ties, applying other types of track fastening technologies or materials.

Rail maintenance modules for performing a variety of tasks upon railroad tracks are known. The typical prior art module includes a self-propelled frame upon which are mounted a motor for propelling the frame along the track, a work station for an operator, at least one operational module for performing a specified task, and some form of control apparatus for controlling the operational modules. In conventional rail maintenance modules, the operator normally positions the operational module over a target area by visually detecting the location of the target, and then manually aligns the operational module over the target by moving the entire rail machine, using the motor as a gross adjustment. Fine adjustments are made by a manually adjusted spotting carriage, which is usually hydraulically powered.

A major drawback of conventional railway maintenance equipment is that the operator may have to expend considerable lime in accurately positioning the operational module over the target area which may include moving the module in at least one of the forward and reverse directions several times. This increases cycle time, which is a major concern of rail maintenance gang operators, and the railways themselves, which need to efficiently maintain many miles of track.

Some conventional rail maintenance modules have attempted to facilitate the positioning of the operational module over the target by resiliently mounting the operational module, such that the operational module is somewhat self-centering when positioned within a certain limited range from the target. Other maintenance modules have placed sensors upon the operational module to alert the operator when the module is accurately positioned over the target. While both of these improvements have increased the positioning efficiency of rail maintenance modules somewhat, operators and railroads demand even higher positioning efficiency and reduced cycle times.

Despite attempts to automate as many of the alignment and control operations as possible, conventional rail maintenance modules still require the operator to initially visually position the operational module within a certain range of the target before the task is performed. Time may be wasted if the operator slows the module too early to avoid bypassing the target. Conversely, if the operator doesn't slow the module quickly enough and bypasses the target, time is also wasted reversing the movement of the module to return to the target area. While using conventional rail maintenance equipment, the amount of time wasted for the positioning a maintenance module over a single target area may only amount to a few seconds, however, considering the large number of repetitive operations, substantial time may be saved by further automation.

Another aspect of the problems involved with accurately locating rail maintenance equipment over the target relates to the fact that, unlike conventional automated module tools, not only is the operational module typically movable in both parallel and transverse directions relative to the rail, but the machine carrying the operational module is itself also moving over the track.

Another problem related to the automation of rail maintenance operations, and specifically the insertion and driving of lag screws for fastening rail tie plates to ties, is that the lag screw driving mechanism needs a control which will reduce or shut off the driving operation when the screw is fully engaged in the tie, to prevent stripping of the tie hole by overtightening. Conventional control systems for this operation are in some cases unacceptably long in their cycle time, and as such they present a bottleneck in increasing the efficiency of the operation.

Consequently, a first object of the present invention is to provide an improved method and apparatus for efficiently and accurately positioning an operational module over a target area so that a task may be performed upon the target area.

An additional object of the present invention is to provide an improved railway maintenance method and apparatus which permits the accurate automatic positioning of an operational module over a target located on the track.

Another object of the present invention is to provide an improved railway maintenance method and apparatus which reduces the need for the operator to estimate the target area where a task is to be performed, such that the velocity of the module is not prematurely reduced or the target area is not bypassed.

Yet another object of the present invention is to provide an improved railway maintenance machine which can be automatically positioned over a sequence of targets, such as rail tie plates.

Still another object of the present invention is to provide an improved rail lag screw driving control system which prevents overdriving or stripping, while decreasing the cycle time of that operation.

These and other objects of the present invention are discussed or will be apparent from the following detailed description of the invention.

SUMMARY OF THE INVENTION

Accordingly, the above-identified objects are met or exceeded by the present invention. Briefly, the present rail maintenance method and apparatus involves, in part, a self-propelled frame upon which are located at least one maintenance module for performing any one of a variety of tasks upon a predetermined target, a sensor which detects the location of a target area where the maintenance module is to perform its task, an encoder for determining the distance and/or the velocity of the frame, and a control unit for coordinating the movement of the frame unit and the maintenance module.

Some of the important features of the method of operation of the preferred embodiment of the present railway maintenance module are summarized as follows. As the module is propelled along the track, the encoder keeps track of the distance traveled, and the sensor detects targets, such as the tie plates. Once a target is detected, a reading is taken from the encoder, and this reading is stored in the control unit as a target location. Multiple target locations may be sequentially detected by the sensor and stored in the control unit in a queue.

The control trait then determines when a signal should be generated, which either alerts the operator to begin a procedure to stop the module or which automatically stops the module so that the maintenance module is placed over, or near, the target. In this manner, the possibility of mistakenly bypassing the target is essentially eliminated because the operator is alerted when to reduce the velocity of the module or the velocity is reduced automatically when the module is in proper position over the target. Further, for the same reason, no time is wasted by prematurely reducing the velocity of the module.

In applications when the maintenance module is independently movable on the frame, the control unit either signals the operator to reduce the velocity of the module to reach the target area, or it automatically controls the velocity of the module when the maintenance module is in the vicinity of the target. Then, fine adjustments in the position of the maintenance module may be made without any further movement of the entire module. Similar to the velocity control of the module, control of the fine adjustment of the module may also be done either manually by the operator or automatically by the control unit.

The use of this type of fine adjustment saves additional time, because the large engines necessary to propel a rail maintenance module do not generally have very good response time or accuracy. Therefore, the engines may have to be slowed earlier than desired, or the engine may not stop the frame in the exact position desired, thus wasting time. With the use of the fine adjustment method, the deficiencies in the response time and accuracy of the engine are irrelevant because the module may be accurately moved into proper position without the use of the engine. Additionally, as explained more fully below, the use of the free adjustment feature also has the added advantages of permitting multiple modules to be accurately positioned over multiple targets, and it also permits the frame to be driven constantly by the engine while the maintenance modules are held stationary relative to the target by moving the module independently of the module.

More specifically, the present invention provides a system for detecting targets and for positioning at least one work module over a particular target to perform a task thereon. The system includes a movable machine having a main frame, a drive mechanism for propelling the machine across a base surface, a sensor associated with the machine for detecting locations of at least one target positioned on said base surface, and an encoder assembly associated with the machine for obtaining motion data. The motion data includes at least one of the displacement and velocity of the machine across the base surface. Also included is a control unit for receiving the target locations from the sensor, for receiving the motion data from the encoder assembly, for determining a target distance for the drive mechanism to propel the machine such that the work module is generally aligned with a particular target in a target area, and for creating a destination signal indicating when the work module is operationally aligned with the target area.

In another embodiment, a method for detecting targets and for positioning at least one work module over a particular target to perform tasks thereon is provided, including the steps of propelling a machine over a base surface with a plurality of targets located thereon, sensing locations of the targets with a sensor, the sensor being associated with said machine, storing the target locations from the sensor in a control unit, determining motion data consisting of at least one of the displacement and velocity of the machine along base surface, determining a target distance for a drive mechanism to propel the machine such that work module is generally aligned with a particular target in a target area, and creating a destination signal based on the motion data and the target locations stored in the control unit, the destination signal indicating when the module is operationally aligned with the target area; and positioning the machine according to the destination signal. The present invention also encompasses systems for performing the above-described methods.

BRIEF DESCRIPTION OF THE DRAWINGS

FIG. 7A is a flow chart showing the operation of the tie data collecting coarse sensing feature of the present rail maintenance module;

FIG. 7B is a flow chart showing the internal operation of the encoder counter of the present rail maintenance module;

FIG. 10 is a flow chart showing the operation of the second part of the module positioning cycle feature of the present rail maintenance module.

DESCRIPTION OF THE PREFERRED EMBODIMENT

Figure 1:
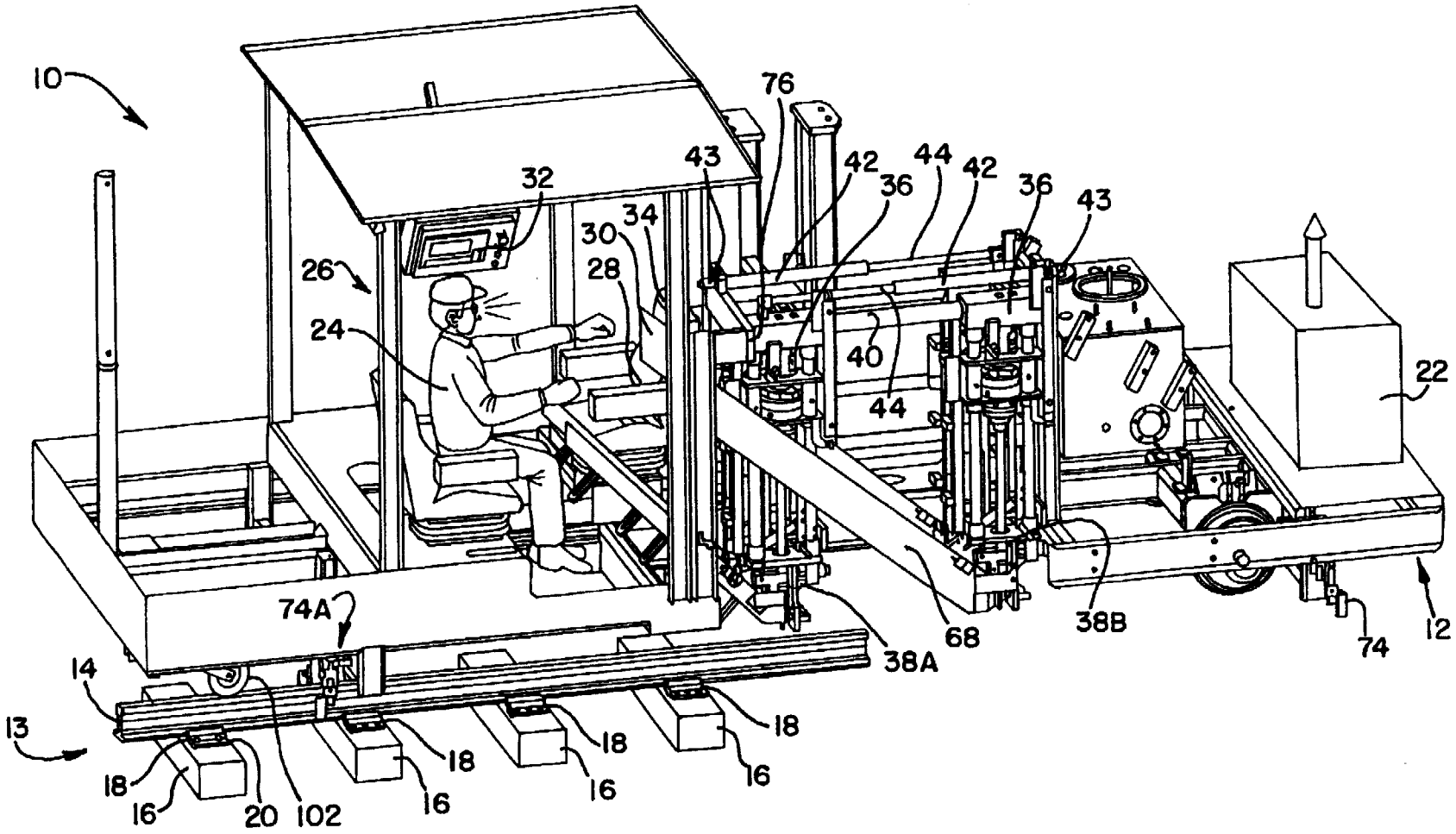
FIG. 1 is a fragmentary top perspective view of a preferred embodiment of the present rail maintenance module.

Referring now to FIG. 1, a preferred embodiment of the present rail maintenance apparatus or machine is generally indicated at 10, and includes a frame 12 upon which the major components are attached. The rail maintenance machine 10 is configured to travel along a standard railroad track 13, which includes a pair of rails, one of which is shown as rail 14. However, it is contemplated that the invention may also be configured for use with a machine that travels along a single rail, or even with a machine that does not travel along rails at all, with the appropriate modifications. Also, while the majority of the description of the preferred embodiment refers to a maintenance machine for performing particular tasks on a railroad track, other types of machines for use in conditions where one would find a plurality of targets upon which tasks are to be performed by a mobile operational machine are also contemplated as being within the scope of the invention.

The railroad track 13 includes the rails 14 (only one of which is shown), which are attached to, and supported by, a plurality of railroad ties 16. The rails 14 are connected to the ties 16 by a series of tie plates 18, which are each affixed to one of the rails 14, and are then mounted to a corresponding tie 16 by a plurality of fasteners 20 (best shown in FIG. 4), as known to one skilled in the art. Examples of some types of the such fasteners 20 include lag screws, railroad spikes, anchors, clips, and the like known to those skilled in the art. However, in the preferred embodiment, the fasteners 20 are utilized. It is also contemplated that the present machine 10 may be used in situations where the rails 14 are attached to the ties 16 without the use of tie plates 18.

An engine 22 is positioned on the main frame 12 for propulsion along the rails 14. In the preferred embodiment, the rail maintenance machine 10 is self-propelled by the engine 22. However, it is also contemplated that alternate mechanisms or ways of propelling the frame 12 may be used, including towing with another vehicle, or other ways known to those skilled in the art.

An operator 24 is shown seated in a work station 26. The operator has access to controls 28, such as foot pedals and joy sticks, and may read the status of certain operations from either a control panel 30 or from the control screen 32. A control unit 34 is also included with the present module to coordinate the various commands received from the operator 24, from other input modules (explained in greater detail below), and to convey the necessary information to the operator 24 via the control panel 30 or the control screen 32. The control unit 34 may include a commercially available standard programmable logic controller, (PLC), which is known to the skilled practitioner. In the preferred embodiment, the control unit 34 is a Mitsubishi FX PLC, however equivalent devices known in the art for performing the same function are relays and microcomputers.

Positioned on the frame 12 are at least one and preferably two spotting carriages 36, and upon each spotting carriage 36 is mounted a maintenance module 38A or 38B. By way of example only, the maintenance modules 38A and 38B shown are lag screw applicators, similar to those described in commonly assigned U.S. Pat. No. 5,398,616, issued on Mar. 21, 1995 to Eidemanis et al., and incorporated herein by reference. Since U.S. Pat. No. 5,398,616 includes a detailed description of the components and operation of the lag screw applicator, only a brief summary of some of the main elements of that module has been included herein. Additionally, any number of different types of maintenance modules may be substituted for the lag screw applicators 38A, 38B shown, without departing from the intended scope of the present invention. Examples of other types of maintenance modules which may be substituted for the lag screw applicators are modules for accomplishing the tasks of spike pulling, spike driving and tie boring. It is to be understood that the construction and arrangement of the spotting carriage 36 may change depending on the configuration of the module 38A, 38B.

Further, the preferred embodiment of the present invention also includes a system where the modules may be easily exchanged to enable the rail maintenance module to perform other tasks, or to enable a single rail maintenance module to perform multiple different tasks through the use of multiple different modules. Such a system is described in commonly assigned U.S. Pat. No 5,465,667, issued on Nov. 14, 1995 to Hosking et al., and incorporated herein by reference.

Each maintenance module 38A or 38B is preferably attached to the frame 12 by a respective spotting carriage 36, also called a module carriage (two of which are depicted in FIG. 1), which is capable of being moved linearly (i.e., parallel to the rails 14) relative to the flame 12. Each spotting carriage 36 is supported by at least one beam 40, and preferably the spotting carriage 36 is slidable along the beam 40. In the preferred embodiment, the spotting carriage 36 is also connected to the frame 12 by a fluid power cylinder 42 provided with a Linear Variable Distance Transducer (LVDT) 43. As such, the cylinder 42, preferably a hydraulic cylinder, is referred to as a "smart" cylinder. The smart cylinder 42 includes a shaft or rod 44 which is extendible and retractable within the cylinder 42 to linearly position the module carriage 36 along the beam 40. The smart cylinder 42 performs the dual functions of moving the module carriage 36 via the shaft 44, and through the LVDT, of determining the position of the module carriage 36 along the beam 40. It is contemplated that other linear displacement devices, or actuators with sensors are contemplated as are known in the art as equivalents to the LVDT.

In operation, both the final displacement of the shaft 44, as well as the positioning speed of extending or retracting the shaft, may either be regulated by the operator 24 or automatically, as described more fully below. The variable positioning speed for the displacement of the shaft 44 also contributes to the overall efficiency of the present railroad maintenance module, because once the required extension or retraction of the shaft 44 is known, the positioning speed of that operation can be varied proportionally to the distance that the shaft 44 must be extended or retracted. Thus, if a large extension or retraction is required, the shaft 44 may be moved rapidly, saving time, and then it may be slowed down upon nearing its predetermined extension or retraction point. This operation is accomplished by a proportional valve (not shown) which varies the mount of flow of hydraulic fluid in response to the mount of current or voltage generated by the PLC 34.

Figure 2A:
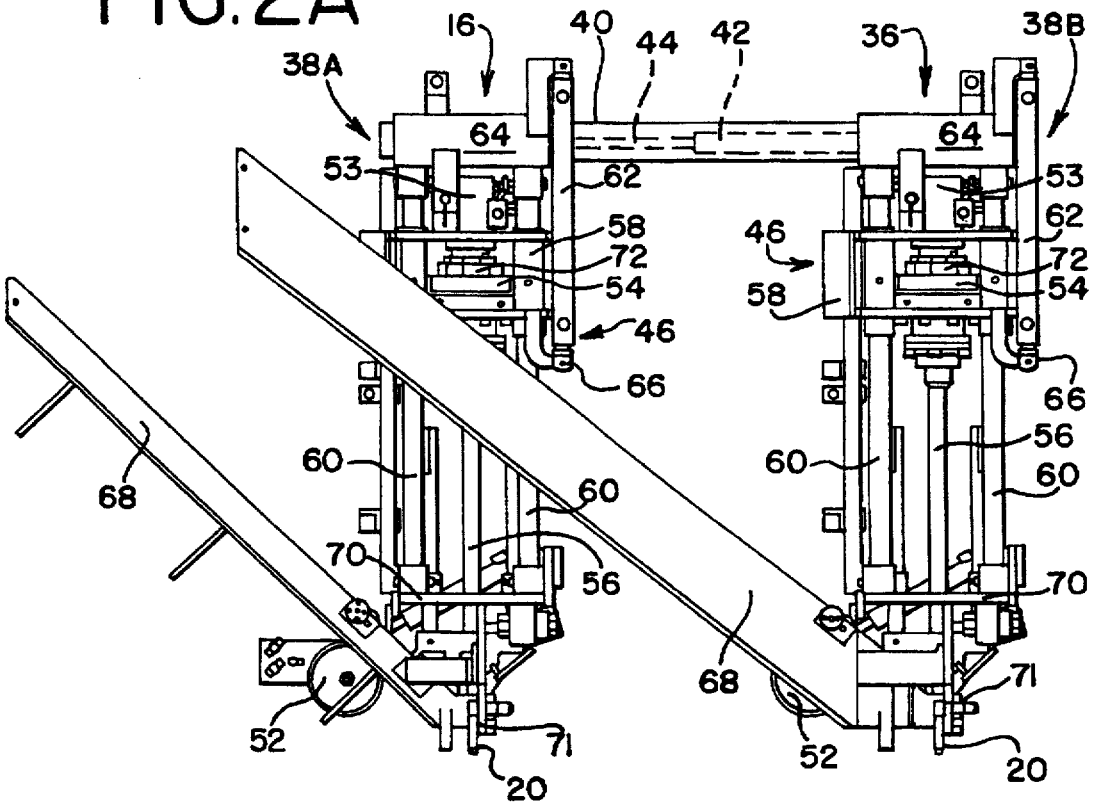
FIG. 2A is an enlarged elevational side view of one type of maintenance module which may be used with the preferred embodiment of the present rail maintenance module.

Referring now to FIG. 2A, two lag screw applicators are shown, by way of example only, as the maintenance modules 38A and 38B, which may be incorporated into the present invention. Basically, each module 38A and 38B includes at least one, and preferably two lag screw or fastener applicator units 46, which are commonly referred to as fastener applicator guns, each configured for placing a lag screw or fastener 20 into a selected hole in a tie plate 18 or a tie 16. Normally, the tie plates 18 each have several such holes into which spikes or lag screws 20 are inserted for securing the rails 14 to the ties 20 (both shown in FIG. 1). Briefly referring to FIG. 2B, a typical railroad tie plate arrangement is shown. Each tie plate 18, respectively designated 18A and 18B, is shown with a corresponding set of four holes, a first set of holes 48A and 48A', 50A and 50A', and a second set of holes 48B, 48B', 50B and 50B'.

Referring back to FIG. 2A, two modules 38A and 38B are shown with only one fastener applicator gun 46 being visible on each module. The second fastener applicator gun (not shown) on each module 38A and 38B is positioned directly behind the illustrated guns 46. Referring to both FIGS. 2A and 2B, the guns located at 38A are configured to secure lag screws 20 into the holes 48A, A' and 50A, A', and the guns located at 38B are configured to secure lag screws 20 into the holes 48B, B' and 50B, B'.

In the preferred embodiment, attached to the bottom of the fastener applicator unit 46, is a pair of beveled guidance wheels 52 (shown with only one wheel visible on each gun 46). The beveled guidance wheels 52 are included with the applicator unit 46 to provide essentially continuous alignment in the direction transverse to the rails 14. If this continuous transverse alignment option is desired, the module carriage 36 should be designed to be somewhat pivotable about the beam 40. In operation, the beveled guidance wheels 52 may then ride along each side of the head of the rail 14 to maintain the gun 46 in proper transverse alignment.

To supply the rotational force required to insert the lag screws 20, a hydraulic motor 53 having a gear box 54 and an elongate, depending extension 56 is mounted to a motor frame 58. The motor frame 58 is slidably connected to a plurality of vertically extending module shafts 60. A fluid, power cylinder 62 is used to reciprocally move the motor frame 58 upon the module shafts 46. The fluid power cylinder 62 is connected between a module carriage tress 64 and a tab 66 located on the motor frame 58. Also provided is a lag screw tray or magazine 68, which is inclined from an area within reach of the operator's seat toward a point below a feeder frame 70 to feed pre-aligned lag screws 20 to the jaws 71 by gravity in a manner well known to skilled practitioners.

Figure 2B:
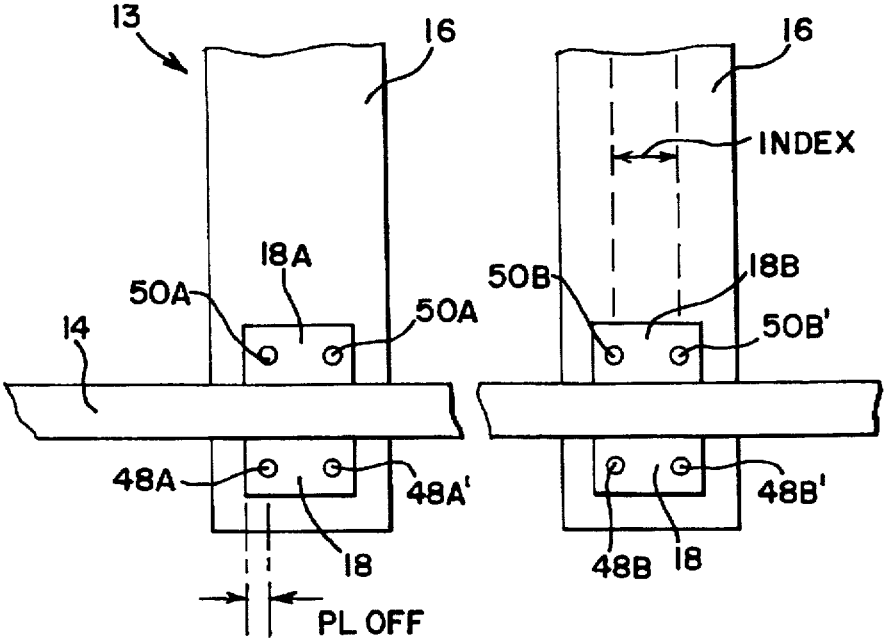
FIG. 2B is a fragmentary top plan view of a section of conventional railroad track.

The hydraulic motor 53 or equivalent device 54 provides the driving force for the insertion of the lag screws 20 into the holes 48A–B, 48 A'–B', 50A–B and 50A'–B' in the tie plates 18 (shown in FIG. 2B). In a preferred embodiment, the motor 53 includes a pressure transducer 72 for adjusting the torque of the depending extension 56. The pressure transducer 72 is provided to prevent the lag screws 20 from being stripped by over tightening. In operation, the pressure transducer 72 permits the extension 56 to be rotated by the motor 53 at high speed with low torque at the start of the tightening operation of the lag screw 20, when it is typically easier to turn the fastener 20. When the tightening operation is near completion and the fastener becomes more difficult to turn, the pressure transducer 72 senses greater pressure and automatically reduces the rotational speed of the motor 53 and thus increases the torque, such that the lag screw may be fully tightened, but not over tightened and stripped. In the preferred embodiment, the transducer 72 is connected to the two-speed or variable displacement motor 53 to accomplish this task.

The electronic controls for the hydraulic function of the lag screw applicator modules 38A, 38B, are contained within the control panel 30 (shown in FIG. 1).

Referring again to FIG. 1, a sensor assembly 74 is shown attached to the frame 12. In the preferred embodiment, the sensor assembly 74 is shown toward the front of the main frame 12. Although the invention will still function properly with the sensor assembly 74 placed anywhere along the main frame, to reduce the time required to properly position the maintenance module 38, the sensor assembly 74 should be placed at a remote, fixed location with respect to a base position 76 of the module 38. To provide for more efficient sensing during reverse movement of the main frame 12, a second sensor assembly 74A may be positioned toward the rear of the main frame 12. Each sensor assembly 74, 74A is electrically connected to the control unit 34.

The sensor assembly 74 includes at least one and preferably two sensor units 75, 75A which may be chosen from any number of known different types of sensing devices capable of sensing the location of a leading edge of a tie plate 18 or other target. Such known types of sensors include those using proximity switches, inductance, ultrasonic waves, magnetic waves, MRI, lasers, or infrared light. For the preferred embodiment, an inductance sensor has been chosen.

Figure 3:
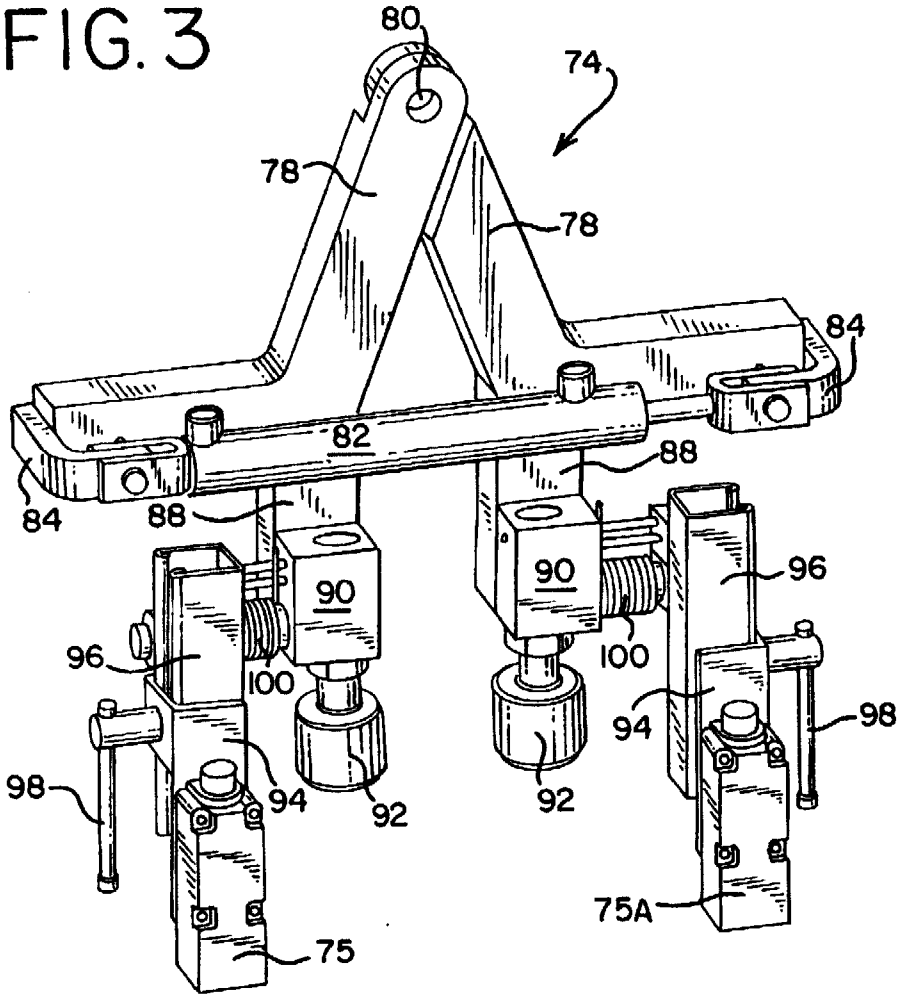
FIG. 3 is an enlarged front perspective view of the sensor of the preferred embodiment of the present rail maintenance module.

Referring now to FIG. 3, the details of the preferred embodiment of the sensor assembly 74 are shown. The sensor assembly 74 is attached to the underside of the main frame 12 using two generally L-shaped members 78 which are pivotally connected to each other, and to the frame 12 at a pivot point 80. The pivoting action of the L-shaped members 78 is governed by a sensor cylinder 82, which has each end connected to a bracket 84 extending from a free end of each of the L-shaped members 78. Operation of the cylinder 82 may be manually controlled by the operator 24 from the control panel 30 (shown in FIG. 1) or it may be controlled automatically by the control unit 34 (also shown in FIG. 1). The inclusion of the cylinder 82 permits the sensor units 75, 75A to be taken out of contact with the rail 14 when the use of the sensor assembly 74 is not desired, such as when the main frame 12 is merely travelling to or from a particular stretch of track and not performing work on that track at the time. Thus, unnecessary track fouling damage to the sensor units 75 may be avoided.

Attached to each of the L-shaped members 78 is a leg 88, upon which is mounted a roller support 90 and a corresponding rail roller 92. The rollers 92 guide the sensor assembly 74 along the rail 14, and are biased against the rail by the cylinder 82. To provide the actual sensing function, the inductance sensor units 75, 75A are adjustably connected to each of the roller supports 90 through the mounting brackets 94, which are slidably fastened in a channel 96. The position of the inductance sensor units 75, 75A may be adjusted along the length of the channel 96, and may be fixed in the desired position by tightening a lever 98. A shock absorbing assembly, such as a pair of coil springs 100, are positioned between the roller supports 90 and the channels 96 to prevent damage to the sensor units 75, 75A by pivoting away as the sensor units impact obstructions such as rail debris or other track obstructions.

Shown toward the bottom left-hand side of FIG. 1 is an encoder assembly 102. Generally, the encoder assembly 102 measures at least one of the displacement and/or the velocity of the main frame 12 along the rails 14. The encoder assembly 102 is bidirectional, and may be placed anywhere on the main frame 12, as long as accurate displacement and/or velocity readings may be obtained.

Figure 4:
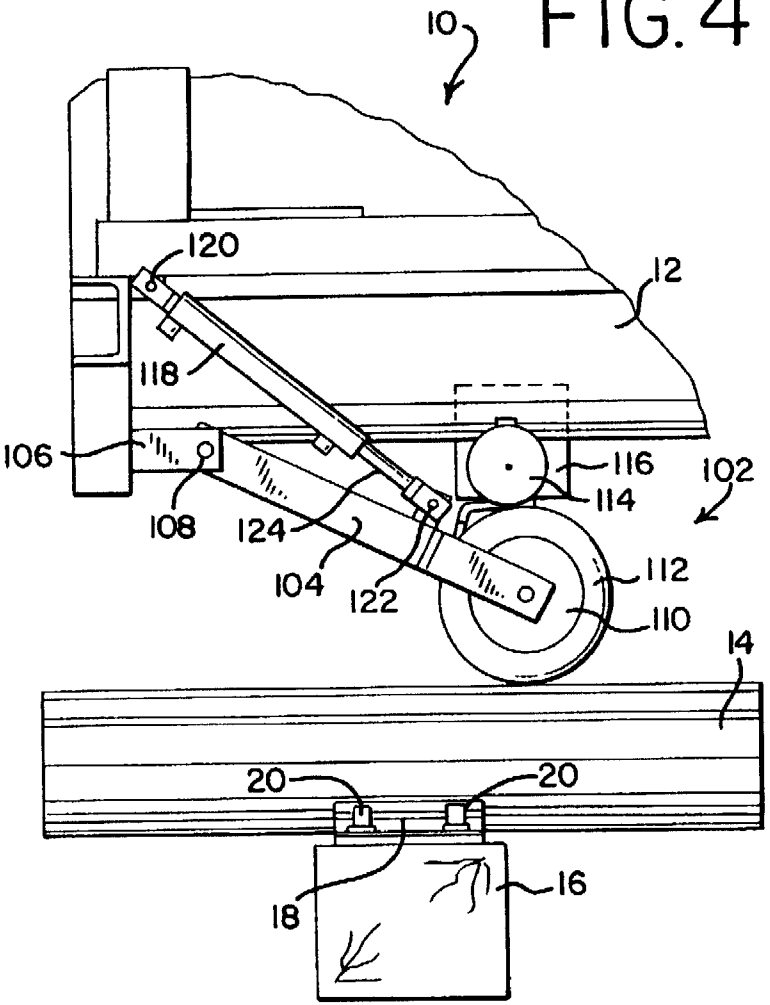
FIG. 4 is a side elevational view of one type of the encoder of the preferred embodiment of the present rail maintenance module.

Referring now to FIG. 4, the encoder assembly 102 is shown in greater detail. The encoder assembly 102 includes several components which are all attached to the main frame 12 by an encoder arm 104, which is pivotally attached to a bracket 106 at a pivot point 108. Connected to the lower end of the encoder arm 104 is a rail wheel 110, which preferably includes an elastomeric fire 112 thereon. The tire 112 helps to reduce slippage of the rail wheel 110 with respect to both the rail 14 and with respect to a counter wheel 114.

During operation, the fire 112 of the rail wheel 110 rides along the rail 14, rotating the counter wheel 114, which causes the generation of periodic pulses in an adjacent encoder 116 (shown partially with hidden lines). When the diameter of the tire 112 is factored in, the number of pulses per revolution of the tire 112 is reflective of the distance traveled by the machine 10. In the preferred embodiment, pulses are generated by the encoder at each 0.025 of an inch, however it is contemplated that the rate may change depending upon the application. By monitoring the pulses, the encoder 116 sends electrical impulses to the control unit 34. The control unit 34 then converts the impulses into distance traveled and/or velocity values of the machine 10 with respect to the rail 14. Velocity is determined by measuring the distance traveled data in relation to elapsed time.

A mechanism is provided for retracting the encoder assembly 102 from contact with the rail 14 when the use of the encoder assembly is unnecessary. Included as a part of this mechanism is preferably a fluid power, such as a hydraulic cylinder 118, which is pivotally attached to the main frame 12 at a first pivot point 120, and which is also pivotally attached to the encoder assembly arm 104 at a second pivot point 122. When a shaft 124 is fully extended, the tire 112 of the rail wheel 118 will be riding upon the rail 14. For periods when no encoder assembly readings are desired, the shaft 124 is retracted, thus pulling the tire 112 out of contact with the rail 14, and avoiding unnecessary wear or damage to the encoder assembly 102.

In operation, the rail maintenance machine 10 may be positioned over a target, such as a tie plate 18, either manually by the operator 24 or automatically. A switch (not shown) is provided as part of the controls 28 (shown generally in FIG. 1) to enable the operator to choose between a manual positioning mode and an automatic positioning mode. A second switch (not shown) is also provided as part of the controls 28 which enables the operator 24 to select between the work mode and a travel mode. When the travel mode is selected, the encoder assembly 102 and the sensor 74 are retracted out of contact with the rails 14 to avoid unnecessary wear on, or damage to, these components. Many of the other components will also be rendered inoperative by the control unit 34 when the travel mode is selected, as described more fully below.

Figure 5:
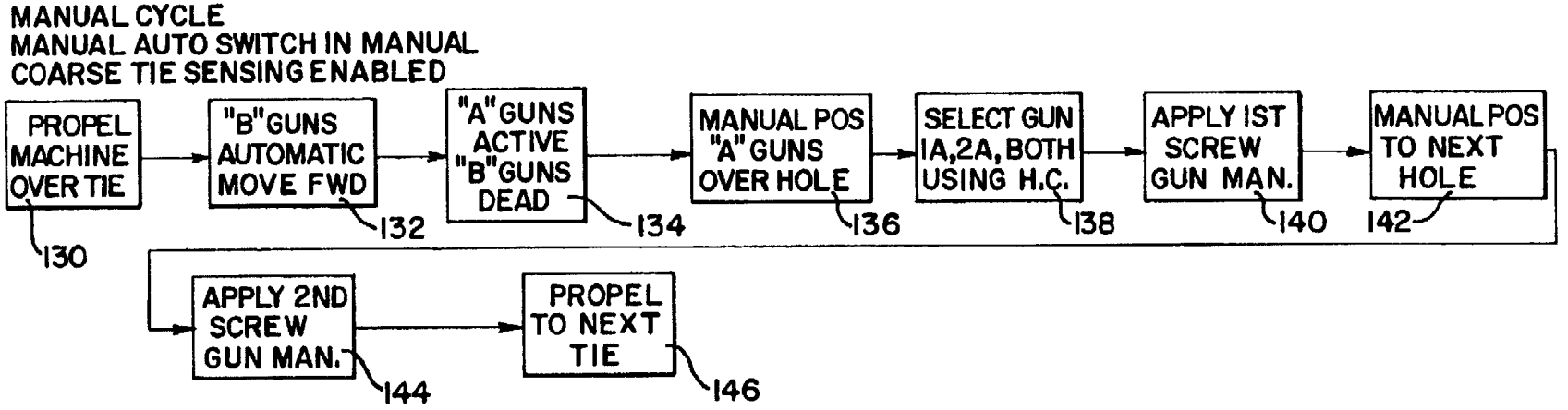
FIG. 5 is a flow chart showing the operation of the present rail maintenance module in the manual mode.

Referring now to FIGS. 1 and 5, the manual mode will be described first in conjunction with both the flow chart of FIG. 5 and the general view of the rail maintenance machine 10 shown in FIG. 1. First, as shown in manual positioning block 130, the operator 24 manipulates the controls 28 to direct the engine 22 to propel the main frame 12 to an area where the gun set 38A is positioned generally over a tie plate 18 upon which a task, such as the insertion of a lag screw 20, is to be performed. During manual operation, only one set of fastener applicator guns 46 (or more generally, one set of modules 38), designated as the "A" guns 38A, are capable of being positioned by a single operator at a time. Therefore, a second set of guns 46, designated as "B" guns 38B, are automatically directed by the control unit 34 to be moved, via the smart cylinder 42, toward the front of the frame 12.

This operation, shown in box 132, gets the "B" guns 38B out of the way of the "A" guns to give the "A" guns room to travel without hitting the "B" guns. In this manner, the operator 24 may visually align the "A" guns 38A with the tie plate 18A (see FIG. 2B). This operation, of moving the "B" guns 38B out of the way, is shown in box 134. Additionally, since the "B" guns 38B will not be used during the manual cycle, they are deactivated or rendered temporarily "dead" by the control unit 34, and the "A" guns 38A are activated, as shown in box 134. Next, as abbreviated in box 136, the operator 24 manually positions the "A" guns 38A over a first set of holes, such as holes 48A and 50A of the tie plate 18A shown in FIG. 2B. This is accomplished when the operator 24 manipulates the controls 28 to command the smart cylinder 42 to precisely position the guns 38A. Once the guns 38A are properly positioned over the first set of holes 48A, 50A in the tie plate 18A, the operator 24 then uses the controls 28 to select whether either one or both of the guns 38A will be used for insertion of lag screws 20 into the first set of holes 48A, 50A on the tie plate 18A, as shown in box 138.

Block 140 shows that the operator 24 then directs the "A" guns 38A, via the controls 28, to insert the lag screws into the first set of holes 48A, 50A. Moving to box 142, the operator then manually positions the "A" guns 38A over the second set of holes, 48A', 50A' on the same tie plate 18A, in the same manner as described accompanying box 136. As abbreviated in box 144, the second set of screws 20 are then inserted into the second set of holes 48A', 50A' in the same manner as the first set of screws were inserted, as described in connection with box 140. Finally, the operator 24 again manipulates the controls 28 to direct the engine 22 to propel the main frame 12 to an area where the gun set 38A is positioned generally over the next tie plate upon which a task is to be performed, as shown in box 146, and the entire method is repeated until all of the tie plates have been worked on.

Figure 6:
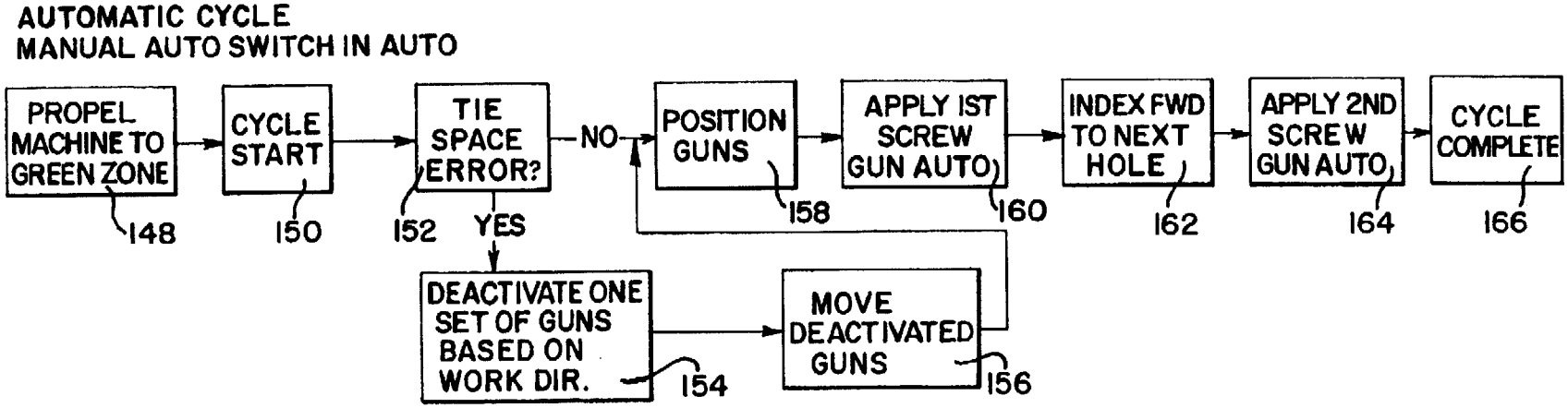
FIG. 6 is a flow chart showing the operation of the present rail maintenance module in the automatic mode.
Figure 7C:
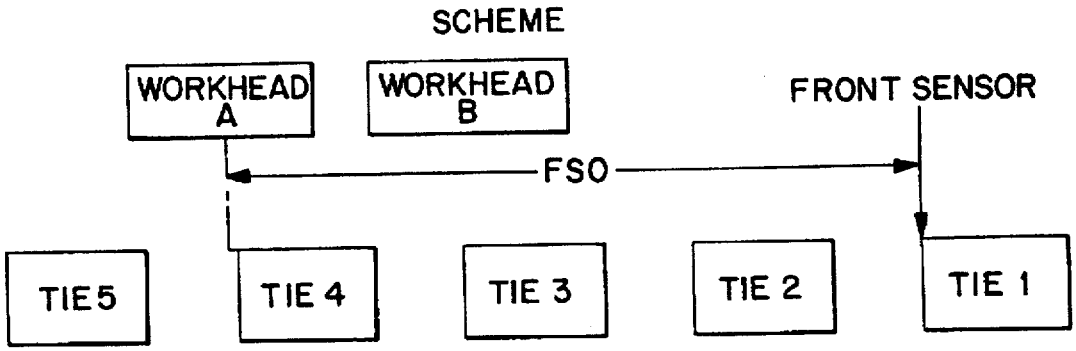
FIG. 7C is a diagrammatic representation of the front sensor offset distance.

Referring now to FIG. 6, the automatic mode will now be described. First, the main frame 12 is propelled to an operational zone or "green" zone, as stated in box 148. Briefly, the green zone is a linear range along the rail 14 where the main frame 12 is positioned such that the guns 38 are located in the vicinity of a tie plate 18, being positioned close enough to the plate so that the module carriage 36 can be moved relative to the main frame 12 by the smart cylinder to perfectly align both of the guns 38A and 38B with a set of holes on two tie plates 18A and 18B. Stated another way, the green zone is essentially a coarse estimate of the position for the frame 12, which places the guns 38A and 38B close enough to the sets of holes 48A, 48A' and 48B, 48B', respectively, in the tie plates 18A and 18B, respectively, to allow the smart cylinder shafts 44 to move the guns 38A and 38B with respect to the frame for fine adjustment over the corresponding tie plate holes. The green zone is determined by the control unit 34, based upon the values obtained from the sensor, the encoder assembly, and various constants input by the operator 24, as explained more fully below in conjunction with FIG. 7.

The main control unit 12 may be propelled to the green zone in one of two ways, either semi-automatically or fully-automatically. When the frame 12 is propelled semi-automatically, the operator 24 controls the operation of the engine 22 to propel the main frame 12 along the rails 14. Once the control unit 34 determines that the frame 12 is positioned in the green zone (the manner in which the control unit makes this determination is explained in conjunction with FIG. 7), it alerts the operator of this condition by providing a signal for him, such as by illuminating a green light located on the control panel 30. Upon perceiving this signal, the operator manually begins to reduce the velocity of the frame 12 by braking or by reducing the driving force supplied by engine 22. If the operator does not reduce the velocity quickly enough and bypasses the operational or green zone, the green light or other signal is discontinued. In this manner, the operator is informed that the green zone has been bypassed, and that he must back up the frame 12 to place it in proper position to perform the designated task.

Fully-automatic operation involves many of the same principles of semi-automatic operation. Except with fully automatic operation, instead of the operator controlling the velocity of the frame 12 upon receiving a signal from the control unit 34 informing him that the unit 12 is within the green zone, the control unit 34 itself directly reduces the velocity of the frame 12 upon generating an internal signal that the frame 12 is within the green zone.

Once the frame has been propelled to the green zone, either fully automatically or semi-automatically, and as stated in box 150, the automatic gun positioning cycle starts. This cycle is explained below in connection with FIGS. 9 and 10. Moving along to box 152, the control unit 34 then determines whether there is a tie space error. A tie space error occurs where the two tie plates 18A and 18B, upon which work is to be performed, respectively, by the guns 38A and 38B (with one gun working on each sequentially positioned tie plate) are located too far apart or too closely together for both of the guns 38A and 38B to each work on a plate simultaneously. A more detailed description of the method of determining if a tie space error is present is described below.

If a tie space error is found, the control unit 34 automatically deactivates one set of the guns 38A or 38B, as stated in box 154. Either the A gun(s) or the B gun(s) may be deactivated, depending on the direction of travel of the machine 10. Next, step 156 is performed, in which the control unit 34 moves the deactivated set of guns, either 38A or 38B, by fully extending the shaft 44 of the appropriate smart cylinder 42 to allow maximum displacement for the other gun.

At this point, the program becomes essentially the same as if there had been no tie space error detected, the only difference being the number of guns that are to be positioned, which is step 158. If no tie space error had been detected, both sets of guns 38A and 38B would be positioned. However, if a tie space error had been detected, only a single set of guns, either set 38A or set 38B, would be positioned.

In order to provide for a simplified disclosure, it will be assumed that no tie space error was present, and that both guns 38A and 38B have been activated. Such an assumption also allows for the fullest explanation of the operation of the present system. Next, in step 160, the control unit 34 commands the positioned guns 38A and 38B to insert the lag screws 20 into the first set of holes in the tie plate. The gun 38A inserts lag screws 20 into the holes 48A and 50A in the tie plate 18A and the gun 38B inserts lag screws 20 into the holes 48B and 50B in the tie plate 18B.

Next, in step 162, the control unit 34 positions, or indexes, the activated guns 38A and 38B over the second set of holes 48A', 50A', 48B', 50B' in the tie plates 18A and 18B by controlling the movement of the shaft 44 of the smart cylinder 42. Box 164 indicates that the control unit 34 then commands the activated guns 38A and 38B to insert the lag screws 20 into the second set of holes on the tie plates. At this point, as indicated by box 166, the cycle is now complete, and the main frame 12 is propelled either automatically or semi-automatically to the next set of tie plates in the same manner as described above in connection with step 148, and the method is repeated until lag screws 20 have been inserted into the holes in every tie plate 18 that is to be worked on by this rail maintenance module.

Turning to FIG. 7A, the method of determining the green zone will now be described. The control unit 34 first determines if the main frame 12 is moving in the forward direction (box 168), if a first one of the inductance sensors 75 has sensed the leading edge of a tie plate 18 (box 170), and if a second one of the inductance sensors 75A has also sensed the leading edge of a tie plate 18 (box 172). As soon as all three of these conditions (from boxes 168, 170, and 172) are met, which is determined by an 'and' gate 174, the control unit 34 takes a counter reading, designated as an "ECOUNT," from the encoder assembly 102, as indicated in box 176. As previously stated, this counter reading, or ECOUNT, may be a reading of the displacement or the velocity of the main frame 12.

It should be noted that the only portion of the tie plate that needs to be sensed by the sensors 75 and 75A is the leading edge. However, most common types of sensing modules, such as the inductance sensors 75 and 75A used in the preferred embodiment will continue sensing the presence of a tie plate for the entire length of the plate, i.e. even after the leading edge has been detected. These additional readings, after the leading edge reading, must be discarded to avoid arriving at an erroneous calculation of the green zone due to this extraneous data input. To discard these extraneous sensor readings, a calculation is performed and the result is compared to a tie constant or "TCONST," as shown in step 178. The tie constant, or TCONST, is equal to the linear length of a tie plate 18, i.e. the length along the rail 14. The calculation performed is, "is ECOUNT−TIE1>TCONST," where TIE1 is the encoder assembly reading stored when the first tie plate has been sensed by the sensors 75 and 75A. This reading is initially zero prior to the sensing of any tie plates. If the calculation of box 178 is performed, and the answer is no, this may indicate that the sensors 75 and 75A are still sensing the same tie plate from which the leading edge has already been sensed. Accordingly, these additional readings may discarded. However, prior to discarding these readings, it must first be determined whether the main frame 12 has been travelling in the reverse direction, which would mean that each subsequent displacement reading from the encoder assembly 102 would be lower than the previous one. The possibility of this condition is considered by the step indicated in box 180, which calculates whether the ECOUNT−TIE1<0. If this condition of step 180 is met, step 182 is performed in which the data stored for each of the ties 1 through 10 are updated.

On the other hand, if the result of the calculation performed in step 178 shows that the ECOUNT minus TIE1 is greater than TCONST, step 184 is performed. In this step, any previously stored values for TIE1, TIE2, etc. are shifted to the next higher numbered storage slot through the use of a first-in-first-out shift register or other commonly known queuing means. In this manner, any predesignated number of tie locations may be stored in the control unit 34. As the machine 10 travels along the track 13, the sensor unit 75 sequentially senses tie plates 18, and their locations to the control unit 34 which places them sequentially in the shift register. For purposes of example only, the preferred embodiment will be explained using ten storage slots, designated as TIE1 through TIE10. As a lag screw is driven into a designated tie plate, the control unit 34 will purge that location value from the queue. Thus, in the preferred embodiment, for example, upon the completion of the maintenance operation, specifically the driving of a fastener, a target reference point, such as the tie plate location value originally designated as TIE1 will be discarded and its place in the queue will be replaced with the value originally designated as TIE2, during step 184. At the same time, once the frame 12 moves forward, a new location TIE10 will be added to represent the location of the tie 18 disposed behind TIE9. It will be appreciated that in situations when the machine 10 operates in the reverse direction, that the shift register or queue will operate in the reverse direction. This function is preferably disabled when the machine 10 is merely traveling across the track 13 in a non operational mode.

Additionally stored with each value TIE1 through TIE10 is an associated range of values for defining the green zone. These stored values are indicated by GRMIN1 through GRMIN 10 and GRMAX1 through GRMAX10. Each value designated as GRMIN corresponds to the minimum encoder assembly reading, wherein the main frame 12 is positioned within the green zone for that specifically numbered tie plate and the previous plate. Each value designated as GRMAX corresponds to the maximum encoder assembly reading wherein the main frame 12 is positioned within the green zone, just prior to leaving the green zone, for that specifically numbered tie plate and the previous one.

As also shown in box 184, each GRMIN value (GRMIN1 through GRMIN 10) and each GRMAX (GRMAX1 through GRMAX 10) value is also shifted through a first-in-first-out shift register, or other commonly known queuing function, similar to the manner by which the TIE values are shifted. As with the TIE values, in the preferred embodiment, the values originally stored as GRMAX10 and GRMIN 10 will be discarded and replaced, respectively, by the values originally stored as GRMAX9 and GRMIN9.

After step 184 has been completed, the control unit 34 then stores the ECOUNT value as TIE1, as indicated in box 186. Finally, at box 188, the control unit 34 calculates and stores the values for GRMAX2 and GRMIN2 according to the following formulas:

GRMAX2=The lesser of:

TIE2+FSO+PLOFF, and

TIE1+FSO−CL+Q+PLOFF

GRMIN2=The greater of:

TIE2+FSO+PLOFF−(Q−INDEX), and

TIE1+FSO−CL+Q+PLOFF−(Q−INDEX)

Where:

FSO=The Front Sensor Offset (a constant), the maximum distance from the sensor 74 to the start position of gun 38A (closest to operator 24).

CL=The Carriage Length (a constant), the usable carriage (See FIG. 7C) length at zero tie spacing.

INDEX=The distance between the two sets of holes on the tie plate (a constant). (See FIG. 2B)

PLOFF=The Plate Offset (a constant), the distance from the leading edge of the lie plate to the first hole. (See FIG. 2B)

Q=The maximum travel distance>1 of gun 38A on the module carriage 36 in the preferred embodiment, this value is 24 inches, however this distance may vary with the application.

The preceding values listed as constants (FSO, CL, INDEX, and PLOFF) may all be determined by the operator prior to starting operation of the rail maintenance module. These values may be input into the control unit 34 via the controls 28. If these values no longer apply to the circumstances of the work being performed, such as, for example, if a different type of tie plate, with a different INDEX, has been used for a length of track, the operator may input the new value for this constant into the control unit, and then continue to operate the rail maintenance machine 10.

Referring now to the flow chart of FIG. 7B, the details of the way the encoder assembly 102 determines an ECOUNT will be described. In order to reset the ECOUNT back to zero, one of three signals must be received by the encoder assembly 102 from the control unit 34. These three signals are: (1) an initial signal that the main frame 12 is to be operated in the forward work direction, designated as block 190; (2) an initial signal that the frame 12 is to be operated in the reverse direction, designated as block 194; and (3) a signal generated upon initially powering up the rail maintenance module, designated as block 192. After any one of these three signals passes through the 'or' gate 196, a momentary pulse 198 occurs, and then the ECOUNT, shown at 200, is reset to zero.

After initialization, the ECOUNT may be increased or decreased as the frame 12 travels in the forward or reverse direction. If the frame 12 is travelling in the forward direction, as shown by the block 202, the readings obtained by the encoder assembly 102 (designated as encoder assembly A in FIG. 7B, and being positioned toward the rear of the frame 12) are added to the ECOUNT, resulting in the internal counter ECOUNT 200. If ate frame 12 is travelling in the reverse direction, as indicated by the block 204, the readings obtained by a second encoder assembly 102 (designated as encoder assembly B in FIG. 7B, and being positioned toward the front of the frame) are subtracted from the ECOUNT, again resulting in the internal counter ECOUNT 200.

Figure 9:
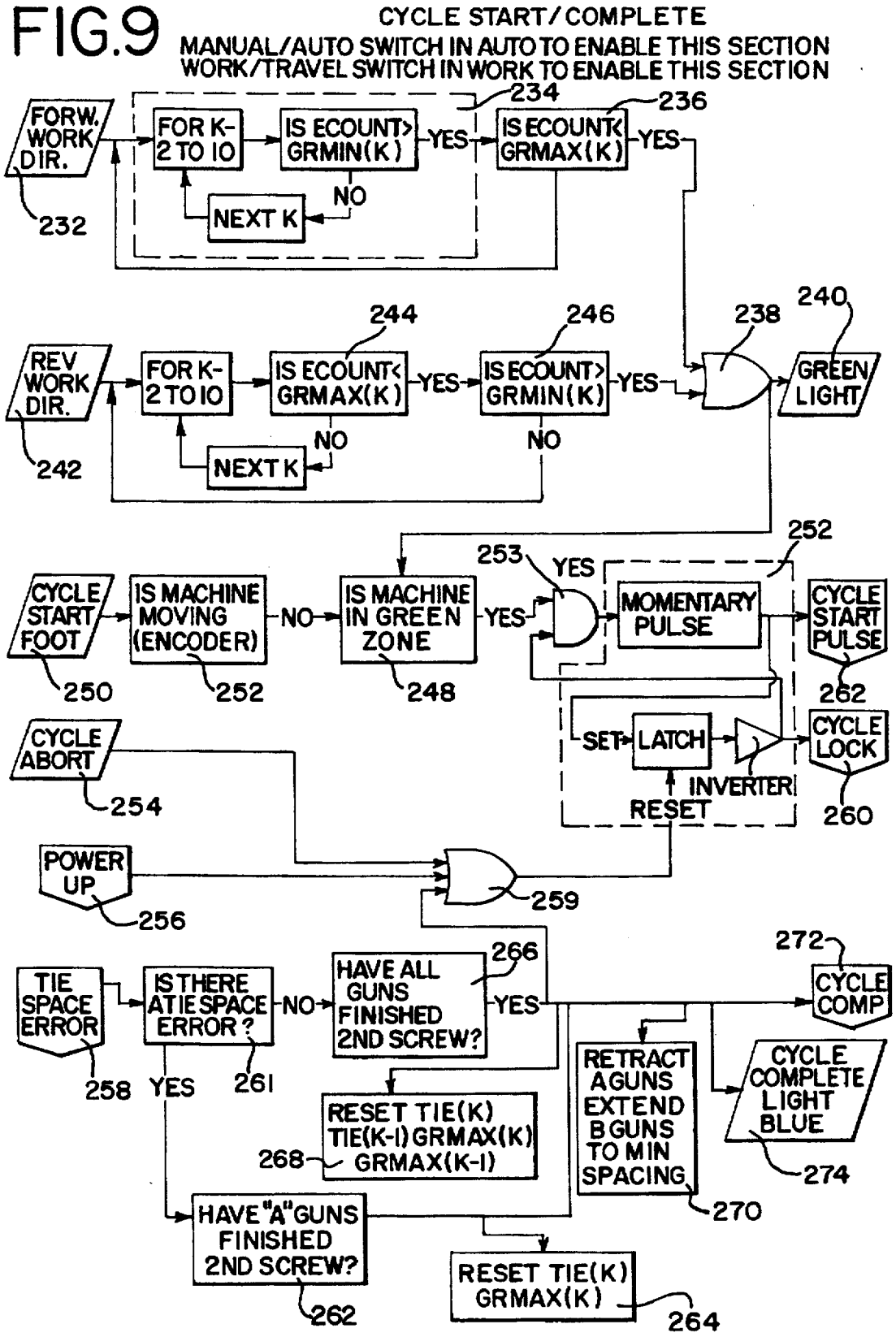
FIG. 9 is a flow chart showing the operation of the first part of the module positioning cycle of the present rail maintenance module, as well as the cycle complete logic.

Referring to the flow chart of FIG. 9, the method for initializing the automatic fine adjustment cycle for the guns 38A and 38B will be described. The cycle may begin when the controls 28 have set the rail maintenance machine 10 in work mode in the forward direction, designated by block 232. Next, a comparison is made to see if any of the stored values GRMIN2 through GRMIN 10 are less than the current ECOUNT, as shown by the loop enclosed by the dashed block 234. If this condition is met, in the next block 236, the current ECOUNT is compared with the single GRMAX value which met the condition of block 234. For example, if K=5 was the first value of K where the ECOUNT was greater than GRMIN(K), then step 236 would involve a comparison of the ECOUNT with GRMAX5. If it is determined that the ECOUNT is less than the specific GRMAX value, as shown in block 236, then a green light may be illuminated, as shown in box 240, indicating that the main frame 12 is located within the green zone.

A similar method may be initiated when the rail maintenance machine 10 is placed in the reverse work mode, seen in block 242. The primary difference between the logic used for the forward direction and that used for the reverse direction is that the GRMAX values are analyzed first, as shown in block 244, and that the GRMIN value compared with the ECOUNT, of block 246, depends upon the GRMAX value meeting the condition of block 244. If the condition of block 246 is met, the signal passes through the 'or' gate 238, and illuminates a green light, as shown in block 240.

If either of the conditions required for passing through the 'or' gate 238 are met, in addition to illuminating a green light (block 240), a signal is also sent to permit the fine adjustment cycle to continue, as shown by block 248. The fine adjustment cycle is started when the operator activates a control, such as a foot pedal located within the work station 26, as indicated in block 253. Next, an encoder assembly reading is taken to make sure that the frame 12 is not in motion, as shown in block 252. If the main frame 12 is not moving, but is instead positioned in a stationary manner within the green zone, one of the conditions required for passage through the 'and' gate 253 is met. The other condition for the passage of the signal through the 'and' gate 253 is shown by the dashed block 252, which prevents the control unit from re-starting the free adjustment cycle once the cycle has already been started, and before the cycle has been completed or aborted. Prior to restarting the fine adjustment cycle, the cycle must first be aborted by the operator, as shown in block 254, or the operator must power up the frame 12 for movement, as shown in block 256, or a tie space error must be detected, as shown by block 258. If either of these three conditions (of blocks 254, 256, and 258) are met, the 'or' gate 259 is triggered and the cycle is permitted to be restarted because there is no cycle currently in progress. In addition, the cycle lock condition of block 260 is implemented, which applies brakes and disables the machine propulsion system during the cycle.

If a tie space error is detected, as indicated by block 258, the control unit 34 first determines if there is actually a tie space error, as shown by block 261. If the answer to block 261 is yes, then the control unit determines if the A guns (the only guns operational in this mode) have completed the second screw insertion operation, as shown on block 262. If the A guns have completed their insertions, then the signal proceeds to block 264, where the values for TIE(K) and GRMAX(K) are reset to the next tie in the queue. Next, the signal proceeds to block 270, where the A guns are retracted to their starting point, and the B guns are set to the minimum spacing by the smart cylinders 42. In the preferred embodiment, the minimum acceptable spacing between the A' and B' guns 46 is 21 inches. However, it is contemplated that this distance may vary with the application and the type of module. Finally, the cycle complete block 272 is reached, and a blue light indicating that the cycle is complete is illuminated on the control panel 30, as shown by block 274.

On the other hand, if the answer to the tie space error question in block 261 was no, then the signal proceeds to block 266, where a status check is made to determine if all the guns (both A' and B' guns) have completed inserting the second set of screws. If they have, then the values of TIE(K), TIE(K−1), GRMAX(K), and GRMAX(K−1) are discarded and the first-in-first-out shift register shifts the remaining stored values, as seen in block 268. The guns are then retracted, as before, in step 270. And the cycle complete signal of block 272 and blue light of block 274 are activated as described above.

Referring now to the flow chart of FIG. 10, the automatic gun positioning operation will be described. This method is initialized when the control unit 34 receives a signal that the automatic adjustment cycle is to be implemented, such as the cycle start pulse 262, as carded over from the flow chart of FIG. 9, or a command to index the second set of lag screws, shown by block 280. The fulfillment of either of these conditions will permit a data signal to progress through the 'or' gate 282 to block 284. Block 284 indicates that a query is made to see if the rail maintenance machine 10 is in the work mode in the reverse direction. This query is important, because if the rail machine 10 has been travelling in the reverse direction, each successive value representing the location of a tie plate (i.e. TIE1, TIE2, etc.) will be higher than the preceding value. In this manner, the value stored for the location of the fifth tie plate, TIE5, will be less than the value stored for the fourth tie plate, TIE4. Knowledge of whether a later stored value is expected to be greater or less than an earlier stored value is important for determining the proper formula to use to calculate certain parameters, such as if a tie space error has occurred. Such a tie space error occurs where two adjacent tie plates are either positioned too closely together, or too far apart, to permit the two guns 38A and 38B to work on the two tie plates simultaneously.

If the rail maintenance machine 10 is in the reverse work mode, two steps (286 and 288), are undertaken to determine if there is a tie space error. First, as indicated in block 286, a calculation is made to see if the two tie plates are positioned too closely together. If the tie plates are not positioned too closely together, a calculation is made to determine if the two plates are located too far apart, as indicated in block 288. If the plates are either too close together or too far apart, a data signal passes through the 'or' gate 290, which moves the "A" gun 38A towards the work station 36 by extending the shaft 44 of its associated smart cylinder 42, as indicated by block 294. The signal passing through the 'or' gate 290 also creates a "tie space error" signal, as indicated by block 258, which corresponds to the "tie space error" signal 258 of FIG. 9, and is one of the possible methods of obtaining a "cycle complete" indication, as explained previously.

If no tie space error is present, a calculation is made to determine where the "A" gun 38A should be positioned by the smart cylinder 42 so that it will be aligned with the appropriate set of holes on the selected tie plate. The result of this calculation is abbreviated as GUNASTPOS, as indicated in block 296. The proper formula for determining the GUNASTPOS is dependent upon whether the rail maintenance machine 10 has been travelling in the forward or reverse direction, and also whether the first set of screws 48A, 48A' or the second set 50A, 50A' (see FIG. 2B) are to be inserted into the tie plate.

The three possible formulas for determining the GUNASTPOS, using the same constants previously described, are:

1. When inserting the first set of screws after travelling in the forward work direction:

GUNASTPOS=TIE(K)+FSO−PLOFF−ECOUNT

Figure 8:
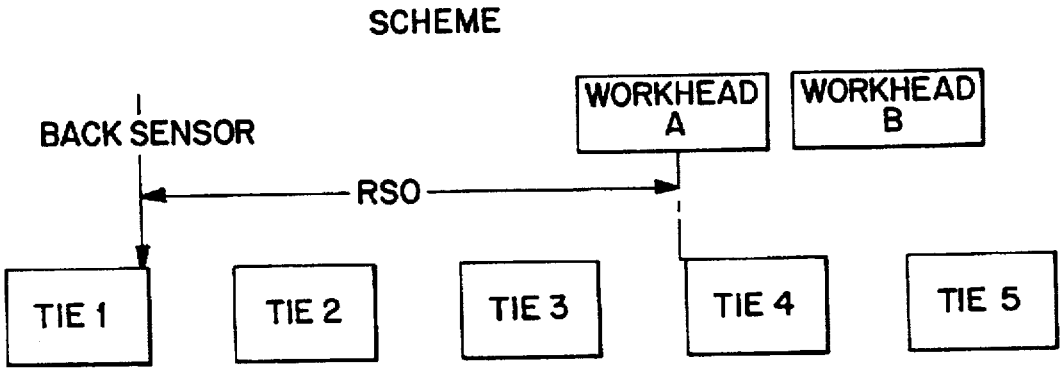
FIG. 8 is a diagrammatic representation of the rear sensor offset distance.

2. When inserting the first set of screws after travelling in the reverse work direction:

GUNASTPOS=ECOUNT−(TIE(K−1)−RSO−PLOFF−INDEX)

where RSO=The Rear Sensor Offset (a constant), the maximum distance from the sensor 74, when placed toward the rear of the flame 12, to the start position of the gun 38A (See FIG. 8).

3. When inserting the second set of screws after travelling in either the forward or reverse work direction:

GUNASTPOS=GUNASTPOS+INDEX

The value obtained for the GUNASTPOS in block 296, and a value representing the present location of the "A" gun 38A obtained from the smart cylinder 42, indicated by block 298, are compared with each other in block 300. If the actual position of the "A" gun 38A and the desired position GUNASTPOS are the same, a data signal 304 is stored in the control unit 34 after a momentary pulse 302. The data signal 304 may be used during an automatic gun operation method to control operations such as the rotation of the hydraulic motor 53 and the vertical movement of the motor frame 58, shown in FIG. 2A, which actually insert the lag screws 20 into the holes in the tie plates. The details of such a method will not be described herein, but should be known to one of ordinary skill in the art.

Referring back to block 300, if the value obtained for the GUNASTPOS in block 296 and the value representing the present location of the "A" gun 38A from the smart cylinder 42, indicated by block 298, are not equal, additional steps are taken to properly position the "A" gun 38A over the holes in the tie plate. The first of these additional steps is a comparison of the current position of the A" gun 38A, from block 298, with the current position of the "B" gun 38B, from block 306. This comparison, indicated in block 308, determines whether the "A" and "B" guns are sufficiently far apart to avoid a possible collision with each other. If the condition of block 308 is met, and if the "A" gun is not in proper alignment with tie plate holes, as indicated in block 300, the control unit 34 determines how far the "A" gun needs to be moved by the smart cylinder 42. As indicated by block 312, if there is a large disparity between the current position of the gun and the desired position (GUNASTPOS), then the control unit 34 directs the smart cylinder 42 to move the "A" gun 38A rapidly. Conversely, if only a small change in position is required, the control unit 34 directs the smart cylinder 42 to move more slowly for more accurate positioning. As indicated by blocks 314 and 294, the actual required movement of the shaft 44 of the smart cylinder 42 may entail either extending (block 294) or retracting the shaft 44 (block 314), depending upon whether the desired movement is, respectively, toward the rear or toward the front of the rail maintenance machine 10.

The procedure for automatically positioning the "B" gun 38B is described in the lower half of the flow chart of FIG. 10. Since this procedure is essentially the same procedure described above with respect to the positioning of the "A" gun, with a few differences, the description will not be repeated here, and only the differences will be discussed. The first way in which the method for positioning the "B" gun differs from the method for positioning the "A" gun is indicated by block 316. In block 316, a query is made as to whether the rail maintenance module is in the work mode in the forward work direction, as compared to the query of block 284 which inquired whether the machine 10 was in the work mode in the reverse work direction. As discussed above, these types of determinations are necessary to determine what set of formulas are to be used.

Blocks 318 and 320 determine the presence of a tie space error when the rail maintenance machine 10 is set for travelling in the forward direction, in a similar manner to that described above in conjunction with blocks 286 and 288. However, instead of moving the "A" gun out of position if a tie space error is detected during the reverse movement of the rail maintenance machine 10, as indicated in block 294, here, the "B" gun is moved out of position if the tie space error is found during the forward operation of the machine 10, as indicated by block 324.

The other primary difference between the upper and lower portions of FIG. 10 is that a different set of formulas are used to calculate GUNBSTPOS than those used to calculate GUNASTPOS. The three possible formulas for determining the GUNBSTPOS are:

1. When inserting the first set of screws after travelling in the forward work direction:

$$GUNBSTPOS=ECOUNT-(TIE(K-1)+FSO-PLOFF-CL)$$

2. When inserting the first set of screws after travelling in the reverse work direction:

$$GUNBSTPOS=(TIE(K)-RSO-PLOFF-INDEX+CL)-ECOUNT$$

3. When inserting the second set of screws after travelling in either the forward or reverse work direction:

$$GUNBSTPOS=GUNBSTPOS-INDEX$$

After the guns 38A and 38B have been properly positioned, the lag screws 20 are inserted by the guns 38A and 38B in a manner known to those skilled in the art. The above described procedure is then repeated until lag screws have been inserted into the desired number of tie plates along a length of track.

In addition to the above-described procedure, a procedure for continuous movement of the rail maintenance machine 10 along the railroad track 13 is also contemplated as being within the scope of the present invention. Minor modifications to the above-described procedure could be made by one skilled in the art such that the rail maintenance machine 10 moves along the track 13 at a relatively constant speed while the control unit 34 continuously repositions the maintenance modules 38, via the smart cylinder 42, so that the modules 38 remain stationary relative to the track 11.

A preferred embodiment of the present invention has been described herein. It is to be understood, of course, that changes and modifications may be made in the embodiment without departing form the true scope and spirit of the present invention as defined by the appended claims.

What is claimed is:

1. A system for detecting targets and for positioning at least one work module over a particular target to perform a task thereon, said system comprising:

a movable machine having a main frame;

driving means for propelling said machine across a base surface;

sensing means being associated with said machine for detecting locations of at least one target positioned on said base surface;

encoding means associated with said machine for obtaining motion data, said motion data including at least one of the displacement and velocity of said machine across said base surface; and a control unit for receiving said target locations from said sensing means, for receiving said motion data from said encoding means, for determining a target distance for said driving means to propel said machine such that said work module is generally aligned with the particular target in a target area, and for creating a destination signal indicating when said work module is operationally aligned with the target area.

2. The system as defined in claim 1 wherein said sensing means is attached to said machine at a remote location with respect to said work module.

3. The system as defined in claim 1 further including a module carriage located on said main frame, said module carriage configured for movably supporting said at least one work module relative to said frame.

4. The system as defined in claim 1 wherein said destination signal comprises a range of values defining an operational zone wherein said machine is generally aligned with said target area.

5. The system as defined in claim 4 wherein said destination signal induces a drive command which controls the operation of said driving means such that said machine is propelled to a location where said module is positioned over said particular target area where work is to be performed.

6. The system as defined in claim 4 wherein said destination signal is perceivable by an operator such that a drive command is manually originated by the operator whereby said drive command stops said driving means from propelling said machine across said base surface at said particular target area.

7. The system as defined in claim 4 further comprising carriage means for moving said work module relative to said machine frame, said carriage means being configured for moving said work module independently of said main frame, said operational zone further comprises a coarse estimate of a range of distance values on said base surface which define said particular target area, and wherein once said module is positioned within said operational zone, said control unit is configured for then controlling said carnage means to achieve at least one level of fine adjustment of said work module over said particular target.

8. The system as defined in claim 6 wherein said control unit is configured for controlling said driving means to continuously move said machine and for controlling movement of spotting means such that said work module is held in a stationary position relative to the particular target upon which work is being performed while said work is being performed.

9. The system as defined in claim 1 wherein said control unit is configured for receiving and storing a plurality of different target locations designated as target location 1 through target location N, each representing the location of a corresponding target.

10. The system as defined in claim 9 where said control unit includes a first-in-first-out queue for storing a fixed number N of different target locations, said queue also being configured for deleting a target location corresponding to a target upon which work has been performed, and for then shifting any remaining target locations within said queue.

11. A rail maintenance device including at least one maintenance module configured for performing at least one type of maintenance work on a railway track, said track having at least one linearly extending rail fastened to a plurality of ties situated generally perpendicularly to the at least one rail, said rail maintenance device comprising:

a machine having a main frame configured for traveling along the track;

a power source for propelling said main frame along the track;

sensing means for detecting a linear location of a target along the at least one rail, said linear location of said detected target being defined as a target location, said sensing means being associated with said machine;

encoding means associated with said machine for obtaining rail data, said rail data consisting of at least one of the displacement and velocity of said machine relative to the rail; and a control unit for receiving said target location from said sensing means, for receiving said rail data from said encoding means, for determining a target distance for generally aligning said module with a particular target area of the track upon which work is to be performed, and for creating a destination signal indicating when said module is operationally aligned with said particular target area.

12. The rail maintenance device as defined in claim 11 wherein said sensing means is attached to said machine at a remote location with respect to said module.

13. The rail maintenance device as defined in claim 11 wherein said destination signal comprises a range of linear values defining an operational zone wherein said module is generally aligned with said particular target area, said destination signal induces a motor command which controls the operation of said power source such that said module is positioned over said particular target area where work is to be performed.

14. The rail maintenance device as defined in claim 13 wherein said destination signal is perceivable by an operator such that said motor command is manually originated by the operator whereby said motor command stops said power source from propelling said machine along said track at said particular target area.

15. The system as defined in claim 13 further comprising carriage means for moving said work module relative to said main frame, said carriage means being configured for moving said work module independently of said main frame.

16. The system as defined in claim 15 wherein said operational zone further comprises a coarse estimate of a range of distance values on said base surface which define said particular target area, and wherein once said module is positioned within said operational zone, said control unit is configured for then controlling said carriage means to achieve at least one level of free adjustment of said work module over said detected target.

17. The rail maintenance device as defined in claim 16 wherein said carriage means includes a means for detecting said location of said module relative to said carriage means.

18. The rail maintenance device as defined in claim 17 wherein said control unit is also configured for controlling said movement of said carriage means in a manner proportional to said target distance whereby a speed of said movement increases as said target distance increases.

19. The rail maintenance device as defined in claim 16 wherein said control unit is configured for controlling said power source to continuously move said machine and for controlling said carnage means such that said maintenance module is held in a stationary position relative to the particular target area upon which work is being performed while said work is being performed.

20. The rail maintenance device as defined in claim 11 wherein said targets are tie plates, and said control unit is configured for receiving and storing a plurality of different plate locations designated as plate location 1 through plate location N, representing the locations of corresponding sequentially located tie plates.

21. The rail maintenance device as defined in claim 20 wherein said control unit includes a first-in-first-out queue for storing a fixed number N of different plate locations, said queue also being configured for deleting said plate location corresponding to a plate upon which work has been performed, and for shifting any remaining plate locations within said queue.

22. The rail maintenance device as defined in claim 11 further comprising a plurality of said maintenance modules, wherein each module is configured for performing a designated task.

23. The rail maintenance device as defined in claim 11 wherein said at least one module comprises a screw applicator for driving threaded fastening means through corresponding tie plates and into the ties to connect a portion of the at least one rail to one of the ties.

24. The rail maintenance device as defined in claim 23 wherein said screw applicator includes a rotatable extension for driving said threaded fastening means through a hole in the tie plate and into the tie; and a pressure transducer for adjusting the torque and rotational speed of said rotatable extension.

25. The rail maintenance device as defined in claim 11 wherein said sensing means comprises:

roller means for guiding said sensing means along said at least one rail;

a sensing element for sensing location of the target, said sensing element being mounted to an arm connected to said roller means; and biasing means for biasing said sensing element into an operational position adjacent the rail, and being constructed and arranged so that upon impact with rail debris, the sensing element temporarily moves out of said operational engagement with the rail, but then returns to said operational position by said biasing means.

26. The rail maintenance device as defined in claim 11 wherein said sensing means comprises:

a sensing element for sensing the location of the target;

roller means for guiding said sensing means along said at least one rail; and idle means for moving said sensing element between an active position where said sensing element is oriented for detecting the location of the target and an inactive position where said sensing element is oriented away from detecting the location of the target and said roller means are out of contact with said at least one rail.

27. A method for detecting targets and for positioning at least one work module over a particular target to perform tasks thereon, said method comprising the steps of:

propelling a machine with a drive mechanism over a base surface with a plurality of targets located thereon;

sensing locations of said targets with a sensing means, said sensing means being associated with said machine;

storing said target locations from said sensing means in a control unit;

determining motion data consisting of at least one of the displacement and velocity of said machine along said base surface;

determining a target distance for said drive mechanism to propel said machine such that said work module is generally aligned with the particular target in a target area; and creating a destination signal based on said motion data and said target locations stored in said control unit, said destination signal indicating when said module is operationally aligned with the target area; and positioning said machine according to said destination signal.

28. The method as defined in claim 27 timer comprising the steps of:

detecting a location of said work module with respect to said machine; and moving said work module independently of said machine such that said positioning of said machine constitutes a coarse estimate of said target area and said moving of said work module constitutes a free adjustment of said work module over said particular target.

29. The method as defined in claim 28 further comprising the steps of:

receiving and storing in said control unit a plurality of target locations designated as target location 1 through location N, wherein each target location 1 through N represents the location of a corresponding target;

storing said target locations 1 through N in a first-in-first-out queue;

performing work on said particular target;

deleting from said queue said target location corresponding to said particular target upon which work has been performed; and shifting any remaining stored target locations within said queue.

30. The method defined in claim 29 further comprising:

propelling said machine continuously over said base surface; and moving said work module such that said work module is held in a stationary position relative to the particular target area upon which work is being performed while work is being performed.

31. A system for detecting targets and for positioning at least one work module over a particular target to perform a task thereon, said system comprising:

a movable machine having a main frame;

driving means for propelling said machine across a base surface;

carriage means located on said main frame for movably supporting least one work module relative to said main frame;

sensing means being associated with said machine for detecting locations of at least one target positioned on said base surface;

encoding means associated with said machine for obtaining motion data, said motion data including at least one of the displacement and velocity of said machine across said base surface;

a control unit for receiving said target locations from said sensing means, for receiving said motion data from said encoding means, for determining a target distance for said driving means to propel said machine such that said work module is generally aligned with the particular target in a target area, and for creating a destination signal indicating when said work module is operationally aligned with the target area;

said control unit is configured for controlling said driving means to continuously move said machine and for controlling movement of said carriage means such that said work module is held in a stationary position relative to the particular target upon which work is being performed while said work is being performed.

32. A rail maintenance device for performing maintenance on a railway track having at least one linearly extending rail fastened to a plurality of ties situated generally perpendicularly to the at least one rail, said rail maintenance device comprising:

a main frame configured for traveling along the track;

a power source for propelling said main frame along the track;

at least one maintenance module configured for performing at least one type of maintenance work on the railway track, said at least one module comprises a screw applicator for driving threaded fastening means through ties to connect a portion of the at least one rail to one of the ties;

said screw applicator includes a rotatable extension for driving said threaded fastening means through a hole in the tie plate and into the tie; and a pressure transducer for adjusting the torque and rotational speed of said rotatable extension.

33. The rail maintenance device as defined in claim 32 wherein said pressure transducer is configured for adjustment of the torque and rotational speed of said rotatable extension from a first combination of high rotational speed and low torque to a second combination of low rotational speed and high torque.

34. A system for detecting targets and for positioning at least one work module over a particular target to perform a task thereon, said system comprising:

a movable machine having a main frame;

sensing means being associated with said machine for detecting locations of at least one target positioned on said base surface;

encoding means associated with said machine for obtaining data reflecting at least one of the displacement and velocity of said machine relative to said base surface; and a control unit for receiving said target locations from said sensing means, for receiving said data from said encoding means, for determining a target distance for said machine such that said work module is placed in general alignment with the particular target in a target area.

35. The system as defined in claim 34 wherein said control unit creates a destination signal indicating when said work module is operationally aligned with the target area.

36. The system as defined in claim 34 further including a module carriage located on said main frame and configured for movably supporting said at least one work module relative to said frame.

* * * * *

UNITED STATES PATENT AND TRADEMARK OFFICE

CERTIFICATE OF CORRECTION

PATENT NO. : 5,671,679

DATED : September 30, 1997

INVENTOR(S) : Straub et al.

It is certified that error appears in the above-identified patent and that said Letters Patent is hereby corrected as shown below:

Column 1, line 43, delete "lime" and insert --time-- therefor.

Column 3, line 43, delete "free" and insert --fine-- therefor.

Column 6, line 43, delete "mount" and insert --amount-- therefor.

Column 7, line 19, after "fluid" delete "," .

Column 15, line 7, delete "free" and insert--fine-- therefor.

Column 19, line 9, delete "carnage" and insert --carriage-- therefor.

UNITED STATES PATENT AND TRADEMARK OFFICE

CERTIFICATE OF CORRECTION

PATENT NO. : 5,671,679

DATED : September 30, 1997

INVENTOR(S) : Straub et al.

It is certified that error appears in the above-identified patent and that said Letters Patent is hereby corrected as shown below:

Column 20, line 16, delete "free" and insert--fine-- therefor.

Column 20, line 29, delete "carnage" and insert --carriage-- therefor.

Column 21, line 43, delete "timer" and insert --further-- therefor.

Column 21, line 50, delete "free" and insert--fine-- therefor.

Signed and Sealed this

First Day of September, 1998

*Attest:*

*Attesting Officer*

Bruce Lehman

BRUCE LEHMAN

*Commissioner of Patents and Trademarks*